United States Patent [19]

Rowley

[11] 4,222,138

[45] Sep. 16, 1980

[54] POSTURE CASE

[76] Inventor: Richard L. Rowley, 141 Maple Ave., Altamont, N.Y. 12009

[21] Appl. No.: 933,522

[22] Filed: Aug. 14, 1978

[51] Int. Cl.[2] ..... A47C 7/62

[52] U.S. Cl. ..... 5/448; 5/474; 150/1; 190/42; 248/461; 297/217

[58] Field of Search ..... 5/355, 361 R, 337, 338, 5/341, 448, 474; 297/217, 219, 313; 190/8, 42; 150/1, DIG. 1; 248/461

[56] References Cited

U.S. PATENT DOCUMENTS

| | | | |
|---|---|---|---|
| 445,400 | 1/1891 | Hayes . | |
| 2,047,035 | 7/1936 | Rosenberg | 190/42 |
| 2,270,598 | 1/1942 | Morgan . | |
| 2,900,012 | 8/1959 | McGlone | 297/219 |
| 3,032,916 | 5/1962 | Oakes . | |
| 3,148,389 | 9/1964 | Lustig | 5/337 |
| 3,167,351 | 1/1965 | Butler | 297/219 |
| 3,222,694 | 12/1965 | Schick | 5/338 |
| 3,511,537 | 5/1970 | Ackerman | 297/454 |
| 3,580,634 | 5/1971 | Bock | 297/313 |
| 3,773,154 | 11/1973 | Mitchell . | |
| 3,876,247 | 4/1975 | Chilewitch . | |
| 3,934,933 | 1/1976 | Long | 5/338 |
| 3,938,569 | 2/1976 | Hill | 5/337 |

*Primary Examiner*—Alexander Grosz

[57] ABSTRACT

A padded carrying case having an inclined plane structure therein. The case is made of a resilient material and when placed on a standard folding chair results in a forward-sloping seating surface. The amount of sloping or pitch can be varied by use of a supplemental shim detachably mounted within the carrying case. The inclined plane member and supplemental shim can be removed from the case and assembled to form a reading stand for musical scores and the like.

10 Claims, 3 Drawing Figures

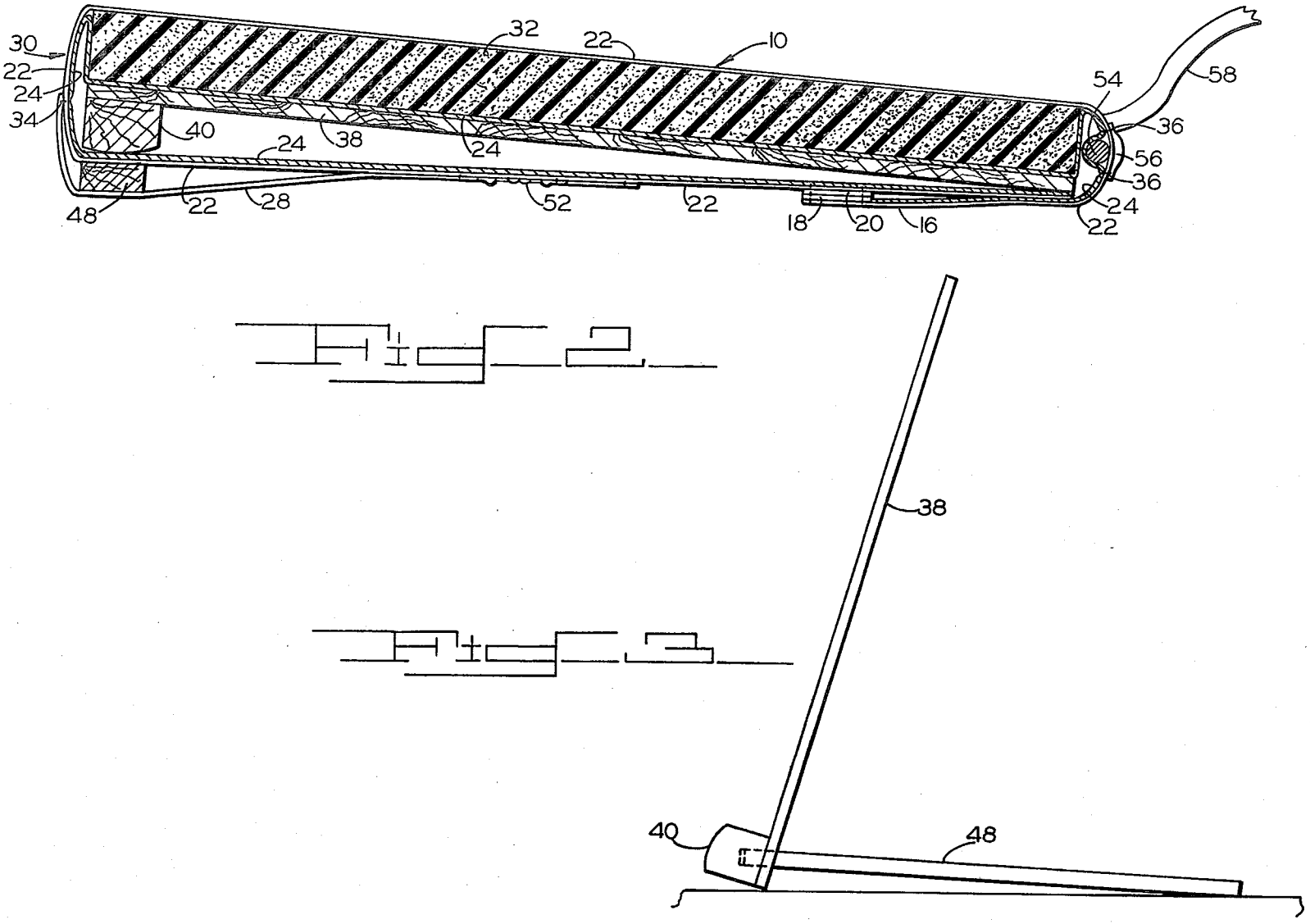
58
36
56
36
24
22
54
16
20
18
10
22
22
52
32
24
38
24
28
22
40
48
30
22
24
34
38
48
40

POSTURE CASE

BACKGROUND OF THE INVENTION

This invention relates to portable cushions for chairs, more particularly, to such cushions of the orthopedic type which may be fabricated in the configuration of a valise or carrying case.

The applicant has found that the rearward portion of the seat on many standard straight chairs is lower than the front portion by about one inch for a seat having a front-to-rear depth of fourteen inches. In other words, the surface of the seat slopes downwardly toward the rear. For convenience, such rearward-facing sloping may sometimes be referred to hereinafter as "negative pitch." Similarly, a seat which is sloped forwardly may be referred to as having "positive pitch."

Ordinarily, a chair having a negative pitch of an inch or so over a distance of fourteen inches is quite comfortable. Indeed, such a configuration may promote relaxation, and, consequently, is well suited for such passive activities as reading, eating or simply quiet sitting. On the other hand, when one is required to work with his limbs while seated, a negatively pitched seat is not desirable. A viola player, for example, finds that he becomes fatigued fairly easily when seated in a standard folding chair having negative pitch. Unfortunately, one routinely finds such chairs in regular use by institutions which provide seating for orchestras and bands and other groups or individuals engaged in non-passive activities.

The applicant has found that the use of a chair having a seat with positive pitch promotes a posture more suited to doing work with one's limbs in front of himself while seated. When a person is seated in such a chair, the sacrum is tilted forward, tending to produce a more normal alignment of the spinal column than would be the case when seated in a chair with negative pitch. Better blood circulation, breathing and nerve flow are thereby promoted. The field of visual focus is widened while tension and fatigue are relieved. Overall posture, comfort and performance are improved.

A further disadvantage involved in using the usual folding chairs for non-passive activities in that the seating surface itself is usually hard and, therefore, produces soreness during any prolonged use.

It would, therefore, be advantageous to provide a portable device which could be applied to a conventional folding chair in order to change its pitch from negative to positive. It would be even more advantageous to provide such a device which would, at the same time, eliminate the problem associated with the hardness of conventional seating surfaces. Finally, recognizing that the user of such a portable device would normally be doing so in connection with some activity such as playing a musical instrument in a band, it would be helpful to provide storage capacity in the device to carry his music folders, record albums or other equipment involved in the activities, as well as such additional items as wallets, key cases and the like which would otherwise cause bulges in his pants pockets and a certain amount of discomfort while the user is sitting. The present invention provides all of these advantages in a clever, compact, durable and relatively inexpensive device which can be carried in the manner of a valise and simply placed on a standard folding chair.

SHORT STATEMENT OF THE INVENTION

The invention has two principal parts, namely, a carrying case and a springy plate inserted therein. The springy plate is elevated at its rear with a shim giving it the overall configuration of an inclined plane. The carrying case is made of a flexible material. When the invention is placed upon a standard folding chair with the elevated portion of the plate to the rear, a positive pitch is produced. The carrying case is further provided with a resilient cushion which, in cooperation with the springy plate produces a relatively soft comfortable seating surface and one which flexes with the movement of the user as he pursues his activity. A supplemental shim is included in order to provide a means for adjusting the amount of change in pitch to be produced by the invention. Finally, the inclined plane member is removable and, in conjunction with the supplemental shim, it may be used as a music stand.

BRIEF DESCRIPTION OF THE DRAWINGS

FIG. 2 is a cross-sectional view of the invention as it would rest on a chair (not shown).

FIG. 3 shows parts of the invention assembled for use as a music stand.

DETAILED DESCRIPTION OF THE PREFERRED EMBODIMENT

Figure 1:
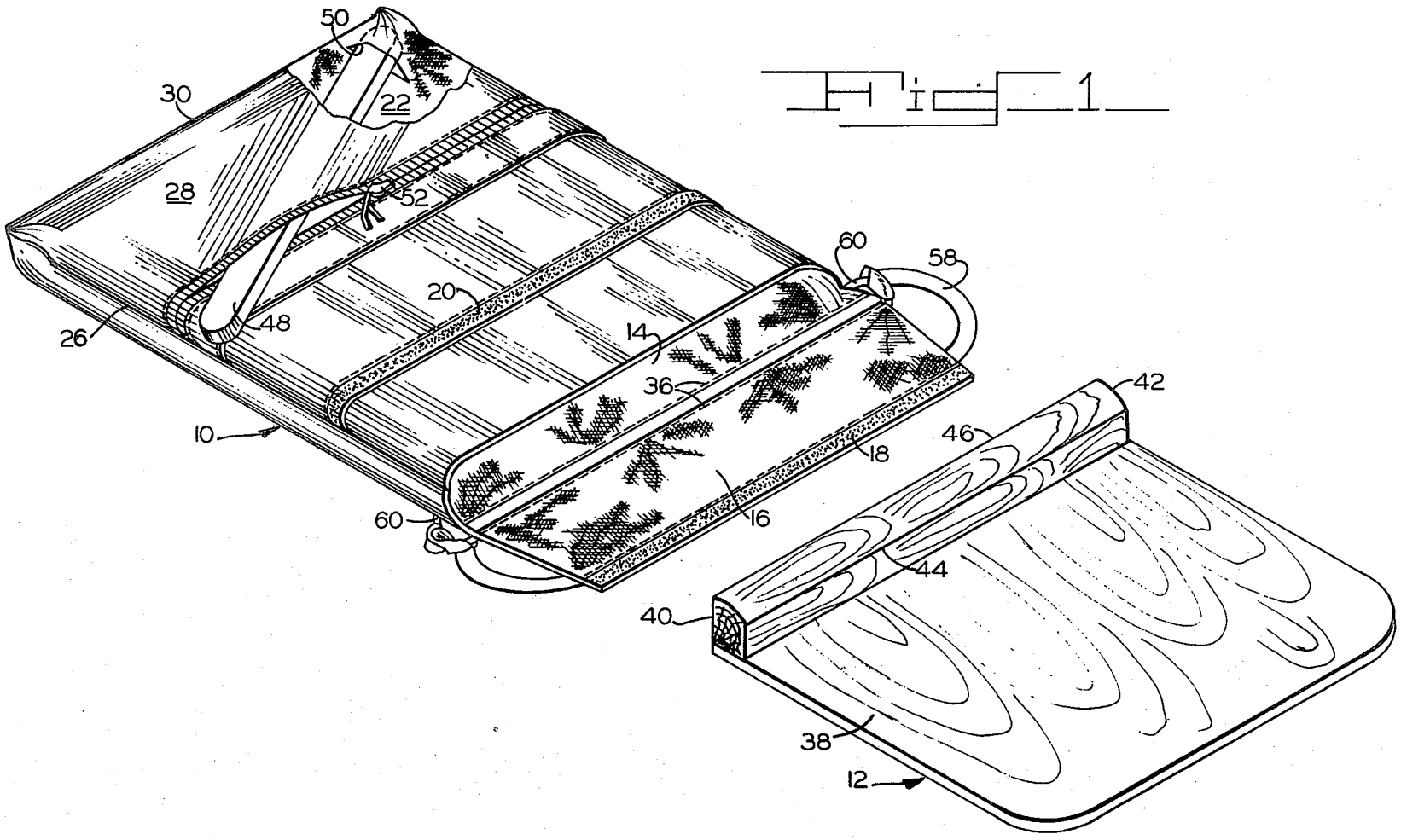
FIG. 1 is a perspective view of the invention with a portion of the carrying case broken away, showing the inclined plane member disassembled therefrom.

FIG. 1 shows the invention in a disassembled state. The two principal parts of the invention are the carrying case 10 and inclined plane member 12. It will be appreciated that the inclined plane member 12 is of such dimensions as will permit it to be inserted into carrying case 10. Opening 14 is provided at one end of carrying case 10 for this purpose. A flap 16 is attached to carrying case 10 as a closure for opening 14. Closure strips 18 and 20 are stitched to flap 16 and carrying case 10, as shown, as a means of securing flap 16 in its closed position, as depicted in FIG. 2.

Carrying case 10 may be constructed of leather, vinyl or any other flexible material. It is recommended that the material have a relatively rough texture on its unfinished side for a reason which will appear hereinafter. The configuration of outer covering 22 of carrying case 10 is best seen in FIG. 2. There it may be observed that a single continuous piece of the outer covering material can be used to go from the flap, continuing along the upper side (in the sense of FIG. 2) and around the bottom and then back along the bottom side, terminating at opening 14. A lining 24 having the same general pattern and configuration of outer covering 22 may be made from any flexible cloth material such as silk, cotton, polyesters or the like. As shown in FIG. 1, the main stitching seams 26 are along the sides of the carrying case, although only one such seam is visible. Closure materials 18 and 20 may be constructed of flexible mating tapes which have the property of adhering to one another once pressed together. One such material which the applicant has found to be very satisfactory for this purpose is that which is sold under the trademark VELCRO. In place of closure strips 18 and 20, any other closure devices could be used. Closure devices of the type indicated are preferable, however, because the continuous seal provided tends to maintain the proper alignment of the carrying case. With individual closure devices such as clasps, the case tends to become somewhat deformed due to the fact that it is constructed of flexible materials.

It will be understood from a study of FIGS. 1 and 2 that an outer pocket 28 is formed by stitching an appropriate material to outer covering 22. Preferably this material would be the same as that of outer covering 22. The stitching for outer pocket 28 is preferably done along main stitching seams 26 and lining stitching seam 34 at rear end 30 of carrying case 10.

Cushion 32 is located between lining 24 and outer covering 22. It is preferably made of a resilient material such as a high density polyurethane foam. Use of such a material permits a good cushioning effect with a thickness of as little as one inch. This is helpful in keeping the invention relatively thin.

It is helpful in holding cushion 32 in place if the inner surface of covering 22 is of a rough texture, rather than a smooth one, so that the tendency of these two elements to slide with respect to one another is minimized. Cushion 32 is also held in place due to the fact that lining 24 is stitched to outer covering 22 along main stitching seams 26, lining stitching seam 34 at the rear end 30 of the carrying case 10 and rod stitching seam 36 at the front end. This configuration of stitching entraps cushion 32 and prevents it from dislocating while the invention is in use. This construction also provides a smooth and slippery lining texture for the interior of carrying case 10, assuming silk or another slippery fabric is used for lining 24. This is important because, as will be more fully appreciated hereinafter, the fit between carrying case 10 and inclined plane member 12 should be snug. Having a smooth and slippery surface within carrying case 10 promotes the easy insertion and removal of inclined plane member 12.

Inclined plane member 12 has two principal parts, springy plate 38 and shim 40. Plate 38 is preferably constructed of a yieldable or springy material having sufficient strength to support the weight of an individual seated on the invention. The inventor has found that a one-quarter inch thickness of all-birch plywood having five plies is very satisfactory. More particularly, plywood sold by the Allied International, Inc. under the trademark BALTIC BIRCH works extremely well in the preferred embodiment. Besides having the necessary strength, this particular kind of plywood tends to have very smooth edges when cut since it has no voids which other plywoods typically have. These edges become even smoother upon application of varnish or other normal finishing materials. Again, the smoothness of the edges of plate 38 promotes the easy insertion and removal of inclined plane member 12 to and from carrying case 10. Also, the use of a plate 38 having a thickness as small as one-quarter of an inch, as indicated above, helps to keep the overall thickness of the invention to a minimum. This is, of course, desirable in that it is not intended to drastically change the height of the seating surface of a chair upon which the invention might be placed. This would be particularly true on the front edge of the chair where it is not necessary to build up the height of the seating surface.

Shim 40 is firmly fastened, as by nailing or gluing to plate 38. The surface 42 of shim 40 which will be closest to the seating surface of the chair in normal use is preferably given an arcuate shape. This tends to accommodate the springing action of plate 38 when and while a person sits on the invention as contemplated. Thus, the axis of pressure contact between the invention and the surface upon which it will rest can change in accordance with the springing of plate 38. If surface 42 were not arcuate, the shim would rest on rear edge 46 or front edge 44, depending upon whether surface 42 were flat or angled and further depending upon the amount of weight being supported by plate 38. It will be appreciated that a strained condition would thus be created between shim 40 and plate 38 which would tend to work the two apart over a period of time. By use of the arcuate shape for surface 42, this condition is eliminated, the springing action of the invention is promoted and the invention is rendered more durable and long-lasting.

As shown in FIGS. 1 and 2, a supplemental shim 48 is provided to cooperate with shim 40 to provide an additional height adjustment at the rear end of the invention. In FIG. 1, supplemental shim 48 is shown partially inserted into carrying case 10. Two slits 50 are provided in outer covering 22, although only one is visible in FIG. 1, for holding supplemental shim 48 in place. A closure such as zipper 52 is provided for outer pocket 28.

The inventor has found it useful to use a stiffener, such as rod 54 at the front of the carrying case 10. This rod can be formed in wood and held in place by stitching between outer covering 22 and lining 24, as shown at rod stitching seams 36. The rod 54 should extend across substantially the entire width of carrying case 10. A suitable handle 56 can also be secured to the front end of carrying case 10 by the same stitching. The purpose of rod 54 is to assist in maintaining the overall shape of the carrying case 10 when it is being carried by handle 56. Since the main structural support for the carrying case is provided by outer covering 22, and since outer covering 22 is preferably of a flexible material, the case would otherwise tend to become deformed when carried. Shoulder strap 58 is secured to carrying case 10 by means of D rings 60 and provides an alternate method of carrying the invention.

In operation, the invention is placed on a conventional chair with inclined plane member 12 in place, as shown in FIG. 2. As noted earlier, it is the case that conventional folding chairs found in most institutions such as schools have a negative pitch amounting to about one inch for a front-to-rear depth of fourteen inches. The dimensions of shim 40 are preferably chosen to produce positive pitch of approximately four degrees above the horizontal on such chairs, without the use of shim 48. With shim 48 in place, as shown in FIG. 2, a positive pitch of about six degrees would result if the shim is about five-sixteenths of an inch thick. It is also possible to achieve a positive pitch of only two degrees with such a shim by placing it under the front end of plate 38, rather than under the rear end as shown in FIG. 2. For most people, a positive pitch of about four degrees is the optimum.

FIG. 3 depicts inclined plane member 12 in use as a music stand. Inclined member plane 12 is supported in an upright position by means of supplemental shim 48. An appropriate socket is formed, as by routing, through plate 38 and into shim 40 to receive supplemental shim 48.

It will be seen in FIG. 2 that storage space is provided within the carrying case when inclined plane member 12 is assembled therewith. The dimensions of this storage space can be conveniently chosen both to accommodate the musical scores typically required for band participation by students in schools while suitably fitting the size of standard folding chairs usually found in schools and other institutional settings. The plate 38 is preferably formed with overall dimensions of fifteen inches in length and thirteen and one-half inches in width. The shim 40 is preferably one inch thick, front to rear, leaving a useful height of fourteen inches, when the inclined plane member 12 is used as a music stand, as described above. The storage space available in carrying case 10 when the invention is in its assembled state will accommodate the usual band folders, which normally measure about fourteen inches by twelve inches. Record albums can also be accommodated.

Additional storage space is available in outer pocket 28 for things like a wallet, car keys and the like. Shim 40 prevents such items from being crushed even when the invention is in use as a chair cushion.

While the present invention has been disclosed in connection with the preferred embodiment thereof, it should be understood that there may be other embodiments which fall within the spirit and scope of the invention as defined by the following claims:

What is claimed is:

1. A posture case for changing the pitch of a chair composed of:

a relatively flat carrying case having an opening at at least one end and being made of a flexible material; and an inclined plane member fit within the carrying case, said inclined plane member being comprised of a springy plate and a shim firmly fastened along an end thereof, said plate and shim defining a storage space within the carying case;

whereby the pitch of a chair may be effectively changed upon placement of the posture case thereon.

2. The invention of claim 1 wherein the shim is provided with an arcuate surface for contacting the chair whereby to accommodate flexure of the plate.

3. The invention of claim 1 or 2 further comprising a resilient cushion mounted within the case so as to rest on the inclined plane member.

4. The invention of claim 3 wherein the carrying case is provided with a cloth lining and wherein the cusion is held in place by stitching between the lining and the case.

5. The invention of claim 1 further comprising a supplemental shim detachably mounted within the case.

6. The invention of claim 5 wherein the inclined plane member is slideably removable from the carrying case and wherein a socket is provided through the plate for receiving an end of the supplemental shim, whereby to form a music stand.

7. The invention of claim 6 wherein the opening of the carrying case is provided with a closable flap.

8. The invention of claim 7 wherein said carrying case is provided with a carrying handle mounted on the exterior of the flap and a stiffener means mounted on the interior of the flap in a position substantially opposite the carrying handle.

9. The invention of claim 8 wherein the carrying case is provided with a storage pocket mounted on its exterior substantially opposite the storage space defined by the plate and shim.

10. The invention of claim 1 wherein the inclined plane member is slideably removable from the carrying case.

* * * * *